US009283411B2

(12) United States Patent
Larsen et al.

(10) Patent No.: US 9,283,411 B2
(45) Date of Patent: Mar. 15, 2016

(54) GAS SENSING DRIFT COMPENSATION USING GAS SELF-REFERENCING FOR END OF SERVICE LIFE INDICATION FOR RESPIRATORS

(71) Applicant: Honeywell International Inc., Morristown, NJ (US)

(72) Inventors: Christopher Scott Larsen, Rockford, MN (US); Peter Tobias, Minneapolis, MN (US); Andrew McIntosh, Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 265 days.

(21) Appl. No.: 13/866,770

(22) Filed: Apr. 19, 2013

(65) Prior Publication Data

US 2014/0311211 A1 Oct. 23, 2014

(51) Int. Cl.
*A62B 7/10* (2006.01)
*A62B 9/00* (2006.01)

(52) U.S. Cl.
CPC ..... *A62B 9/006* (2013.01)

(58) Field of Classification Search
CPC ..... A62B 9/006
See application file for complete search history.

(56) References Cited

U.S. PATENT DOCUMENTS

| | | | |
|---|---|---|---|
| 3,819,282 | A | 6/1974 | Schultz |
| 4,512,191 | A | 4/1985 | Sexton |
| 4,873,970 | A | 10/1989 | Freidank et al. |
| 5,003,985 | A | 4/1991 | White et al. |
| 5,413,097 | A | 5/1995 | Birenheide et al. |
| 5,659,296 | A | 8/1997 | Debe et al. |
| 5,950,621 | A | 9/1999 | Klockseth et al. |
| 6,040,777 | A | 3/2000 | Ammann et al. |
| 7,042,346 | B2 | 5/2006 | Paulsen |
| 7,148,806 | B2 | 12/2006 | Anttila et al. |
| 7,201,036 | B2 | 4/2007 | Custer et al. |
| 7,442,237 | B1 | 10/2008 | Gardner |
| 7,537,648 | B1 | 5/2009 | Karwacki et al. |
| 7,625,760 | B2 | 12/2009 | Kitaguchi et al. |
| 7,638,042 | B2 | 12/2009 | Astle et al. |
| 7,703,455 | B2 | 4/2010 | Bunke et al. |
| 7,736,495 | B2 | 6/2010 | Ikeyama et al. |
| 7,761,188 | B2 | 7/2010 | Palmerton et al. |
| 2005/0188749 | A1 | 9/2005 | Custer et al. |

(Continued)

FOREIGN PATENT DOCUMENTS

| | | | |
|---|---|---|---|
| DE | 19543056 | A1 | 5/1997 |
| WO | 2009029326 | A1 | 3/2009 |
| WO | 2009029426 | A1 | 3/2009 |

OTHER PUBLICATIONS

PCT/US2012/062360, PCT International Search Report, dated Jan. 21, 2014, 5 pages.

(Continued)

*Primary Examiner* — Laura Martin
*Assistant Examiner* — Alex Devito
(74) *Attorney, Agent, or Firm* — Conley Rose, P.C.; Kristin Jordans Harkins

(57) ABSTRACT

Embodiments relate generally to systems and methods for determining end of service life for a respirator cartridge by comparing the gas levels sensed at two or more sample points within the cartridge. Sample streams may run from the sample points to a gas sensor, wherein a valve may control the flow between the sample streams and the gas sensor.

20 Claims, 7 Drawing Sheets

(56) References Cited

U.S. PATENT DOCUMENTS

| | | | | |
|---|---|---|---|---|
| 2007/0240719 | A1 | 10/2007 | Duarte | |
| 2007/0277592 | A1 | 12/2007 | Johansson et al. | |
| 2009/0288561 | A1 | 11/2009 | Palmerton et al. | |
| 2010/0017148 | A1 | 1/2010 | Bos et al. | |
| 2010/0055815 | A1* | 3/2010 | Kim et al. | 438/29 |
| 2010/0153023 | A1 | 6/2010 | Parham et al. | |
| 2012/0085349 | A1 | 4/2012 | Tobias et al. | |
| 2013/0047982 | A1 | 2/2013 | Tobias et al. | |
| 2013/0239813 | A1 | 9/2013 | Rakow et al. | |

OTHER PUBLICATIONS

PCT/US2012/062360, PCT Written Opinion of the International Searching Authority, dated Jan. 21, 2014, 6 pages.

PCT/US2014/033123, PCT International Search Report, dated Aug. 1, 2014, 3 pages.

PCT/US2014/033123, PCT Written Opinion of the International Searching Authority, dated Aug. 1, 2014, 6 pages.

* cited by examiner

GAS SENSING DRIFT COMPENSATION USING GAS SELF-REFERENCING FOR END OF SERVICE LIFE INDICATION FOR RESPIRATORS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD

Embodiments may relate generally to devices and/or methods for detection of end of service life for a filter cartridge, and more specifically to detection of end of service life for a filter cartridge for a respirator.

BACKGROUND

Respirators often use filter cartridges to protect a user from breathing potentially hazardous vapors. When the respirator is in place on the user (typically attached to the face or head in a way to form a seal), air is drawn into the respirator through the filter cartridge whenever the user breathes (and air can typically only enter the respirator through the cartridge, so that the air may be filtered by the cartridge to ensure that air breathed in by the user while wearing the respirator is clean and safe). Such filter cartridges typically contain filtering material that can lock up one or more potentially hazardous vapors. As the filtering material is exposed to the vapor, it typically absorbs the vapor molecules through the pore structure of the material. Thus, by their very nature, the filter cartridges have a limited effective lifespan (after which the filtering material has absorbed all it can, and the cartridge cannot filter additional vapor). Once a filter cartridge has reached the end of its service life, it is no longer effective at protecting the user. Then the user should either remove themselves from the environment with hazardous vapors or else replace the filter cartridge on the respirator with a new cartridge. Thus, to effectively protect the user, it can be important to know when to change filters based on the service life of the cartridge.

Typically, the vapor concentration in the filters is low and reliable detection of the low concentrations by gas sensors (such as metal-oxide sensors or electrochemical sensors) may be affected by significant voltage drift in the sensor. The magnitude of the voltage drift in clean air is often greater than the voltage change between clean air and the contaminated air concentration that an end of service life indicator (ESLI) needs to measure. Therefore, direct measurement by the sensor may not be accurate enough to provide an effective end of service life indication.

Applicants have developed an improved end of service life indicator (ESLI) that may overcome the effect of voltage drift in the sensor. This may allow users to effectively replace filters in a safer way (reducing the risk of unintended exposure to potentially hazardous vapors).

SUMMARY

Aspects of the disclosure may include embodiments of an end-of-service-life indicator system for a filter cartridge for a respirator, comprising one or more of the following: a gas sensor; at least two sample streams from the cartridge alternatively in fluid communication with the gas sensor; and a valve controlling the flow from the at least two sample streams to the gas sensor, wherein the gas sensor may compare the at least two sample streams. In some embodiments, each of the at least two sample streams may sample from sample points within the cartridge and the sample points for the sample streams may be located at different depths within the cartridge, and the system may further comprise an alert coupled to the gas sensor operable to indicate approaching end-of-service-life of the cartridge, wherein approaching end-of-service-life may be indicated when a gas level sensed at a sample point proximate to a rearward end of the cartridge approaches a gas level sensed at a sample point proximate to a forward end of the cartridge. In some embodiments, the gas sensor may comprise one of a metal-oxide sensor or an electrochemical sensor. In some embodiments, the valve may comprise one or more of the following: a piezoelectric valve, a solenoid valve, a bi-stable solenoid valve, a flap valve actuated by the pressure from a user's breathing, a check valve, a valve actuated by user motion, and an electrostatic valve. In some embodiments, the valve may comprise a mechanical valve comprising an indexing mechanism, a diaphragm that activates the indexing mechanism, and a line to the interior of the respirator, wherein the valve may be actuated by the pressure from a user's breathing within the respirator. In some embodiments, the valve may be actuated by the pressure from a user's breathing and may switch the flow to the gas sensor from one of the at least two sample streams to another of the at least two sample streams after a set number of breathing cycles. In some embodiments, the valve may comprise a two-way valve operable to alternate between one sample stream and a mixture of the at least two sample streams. In some embodiments, the valve may comprise a three-way valve operable to alternate between a first sample stream and a second sample stream. In some embodiments, the at least two sample streams may comprise three or more sample streams from three or more different sample points within the cartridge, wherein the gas sensor may compare the sample streams from the three or more sample points. In some embodiments, the system may further comprise an alert in communication with the gas sensor, wherein the alert may comprise a plurality of indications or warnings to indicate to the user when the gas has penetrated to each of the three or more different sample points in the cartridge.

Other aspects of the disclosure may include embodiments of an end-of-service-life indicator system for a filter cartridge for a respirator, wherein the cartridge has a forward end and a rearward end, comprising one or more of the following: a gas sensor; sample streams from at least two sample points in the cartridge to the gas sensor, wherein the gas sensor may compare the gas level of the two sample streams, and wherein one sample point is proximate to the rearward end of the cartridge and another sample point is proximate to the forward end of the cartridge; and a valve controlling the flow from the at least two sample streams to the gas sensor, wherein the valve may comprise: an air tight housing with an opening in fluid communication with the interior of a mask of the respirator and the breathing of a user, and a plurality of ports in fluid communication with the gas sensor and the sample streams, a diaphragm operable to move in response to pressure changes caused by the breathing of the user within the respirator, two or more seals operable to isolate a portion of the housing about one or more of the plurality of ports (wherein the seals may be operable to control flow through the plurality of ports from the sample streams to the gas sensor), and a indexing mechanism coupled to the diaphragm and to the seals, such that movement of the diaphragm activates the indexing mechanism, thereby positioning the seals with respect to the plurality of ports and controlling flow from the sample streams to the gas sensor. In some embodiments, the seals of the valve may allow one sample stream to reach the gas sensor at a time depending on the position of the indexing mechanism. In some embodiments, the indexing mechanism may position the seals to alternate the sample streams at a multiple of breathing cycles of a user, to ensure that the breathing cycle can always be used to drive flow in a single direction to the gas sensor. In some embodiments, the diaphragm of the valve may comprise over-molded rubber and is fixed to an inner wall surface of the housing. In some embodiments, approaching end-of-service-life may be indicated when the gas level sensed at the sample point proximate to the rearward end of the cartridge approaches the gas level sensed at the sample point proximate to the forward end of the cartridge. In some embodiments, comparing the at least two sample streams may overcome the effect of voltage drift on the accuracy of the gas sensor.

Additional aspects of the disclosure may include one or more methods of a method of detecting effective-end-of-service-life for a filter cartridge for a respirator using a gas sensor for detecting gas levels comprising one or more of the following: receiving sample streams from at least two sample points in a filter cartridge, wherein the two or more sample points may be located at different depths within the cartridge; alternating the flow from the sample streams to the gas sensor via a valve; and comparing the gas level present in the sample streams. In some embodiments, the method may further comprise indicating end of service life when the two sample streams approach equality for a second time, wherein initially the sample streams are approximately equal because no gas has penetrated the cartridge, then the sample streams become unequal as gas penetrates to a forward sample point, and then the sample streams approach equality once again as gas penetrates further in the cartridge to the rearward sample point. In some embodiments, a gas sensor may receive the at least two sample streams and may compare the gas level present in the at least two sample streams. In some embodiments, the valve may comprise one or more of the following: a piezoelectric valve, a solenoid valve, a bi-stable solenoid valve, a flap valve or mechanical valve actuated by the pressure from a user's breathing, a check valve, a valve actuated by user motion, and an electrostatic valve.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
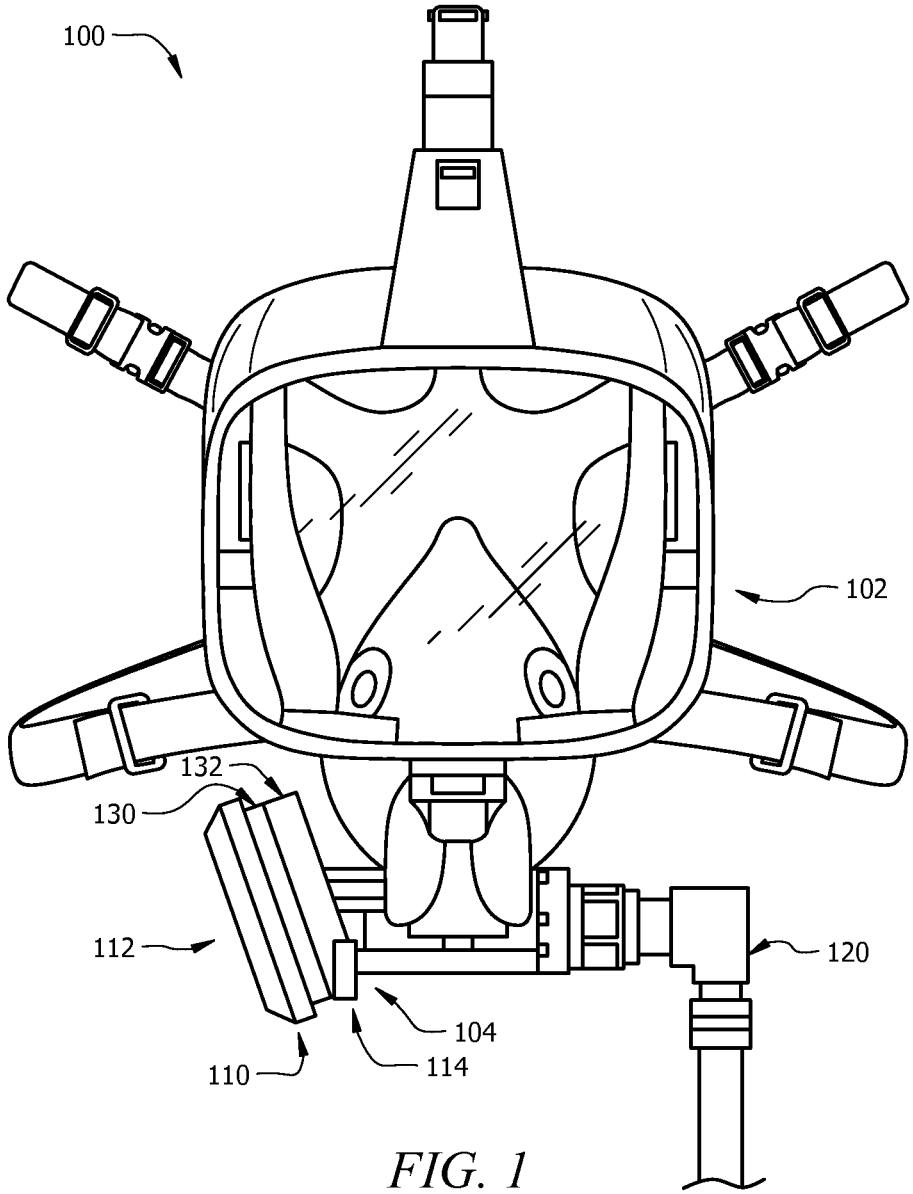
FIG. 1 illustrates schematically an embodiment for sensing gas levels at two or more points in a filter cartridge.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "forward" when used to describe a position within an embodiment means toward or in proximity to the front end of the cartridge, where the front of the cartridge means the end of the cartridge furthest from the attachment to the respirator and therefore furthest from the body of the user. Thus, forward might for example mean away from the user and/or the air intake of the respirator.

The term "rearward" when used to describe a position within an embodiment means toward the rear end of the cartridge, where the rear of the cartridge means the end of the cartridge closest to the attachment to the respirator and therefore closest to the body of the user. Thus, rearward might for example mean toward the user and/or the air intake of the respirator.

The term "effective end of service life" means an estimate of the end of service life of a filter cartridge, when the filter cartridge will no longer effectively absorb vapors and offer adequate protection for a respirator user in an environment with vapors; the estimate may include a margin of error or safety margin and typically would allow a user to be warned to replace the filter cartridge while there is still some life in the cartridge.

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Disclosed embodiments generally relate to methods, as well as devices for implementing such methods, for determining effective end of service life for a filter cartridge for a respirator. In considering ways to measure the service life of a filter cartridge for a respirator, Applicants noted that some sensors, such as metal-oxide sensors or electrochemical sensors, exhibit significant drift when directly measuring vapor concentration. The magnitude of the voltage drift in clean air is often greater than the voltage change between clean air and the contaminated air concentration that an end of service life indicator (ESLI) needs to measure. Therefore, direct measurement by the sensor may not be accurate enough to provide an end of service life indication.

Applicants have developed systems and methods for detecting effective end of service life for a respirator cartridge that comprises comparing two or more different sample points within a cartridge, wherein the sample points may be located at different depths within the cartridge. The two or more sample points within the cartridge may comprise a forward sample point proximate to a forward end of the cartridge and a rearward sample point proximate to the rearward end of the cartridge. The forward (or front) end of the cartridge may mean the end of the cartridge furthest from the attachment of the cartridge to the respirator and therefore furthest from the body of the user. Thus, forward might for example mean away from the user and/or the air intake of the respirator. The rearward (or rear) end of the cartridge may mean the end of the cartridge closest to the attachment to the respirator and therefore closest to the body of the user. Thus, rearward might for example mean toward the user and/or the air intake of the respirator.

Initially, the forward and rearward sample points may indicate similar gas levels, which may be detected by a gas sensor, because no gas has penetrated the cartridge material. Then, as the gas penetrates into the cartridge material, the gas level detected from the forward sample point may increase higher than the gas level detected from the rearward sample point. As the gas penetrates deeper into the cartridge material, the gas level detected from the rearward sample point may increase and approach the level sensed from the forward sample point. Approaching end of service life may be indicated, in some embodiments, by an alert coupled to the gas sensor, when the gas level sensed at the rearward sample point (proximate to a rearward end of the cartridge) once again approaches the gas level sensed at the forward sample point (proximate to a forward end of the cartridge).

FIG. 1 illustrates an exemplary respirator system 100 comprising a mask 102 and a cartridge 110. In some embodiments, a respirator system 100 may also comprise a power air hose 120, operable to supply clean breathing air to a user of the respirator mask 102. The cartridge 110 may comprise a forward end (or front) 112, wherein the forward end 112 of the cartridge 110 means the end of the cartridge 110 furthest from the attachment 104 to the respirator mask 102 and therefore furthest from the body of the user. The cartridge 110 may also comprise a rearward end (or rear) 114, wherein the rearward end 114 of the cartridge 110 means the end of the cartridge 110 closest to the attachment 104 to the respirator mask 102 and therefore closest to the body of the user.

Figure 2A:
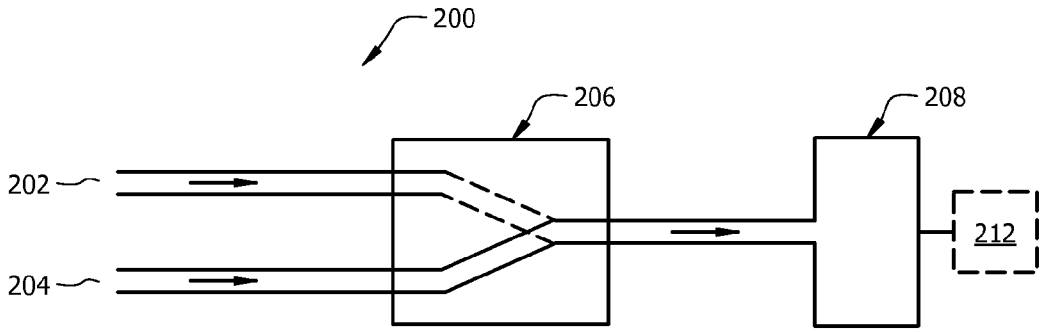
FIGS. 2A-2C illustrate embodiments of a valve that may be used to control flow from sample streams to a gas sensor.
Figure 2B:
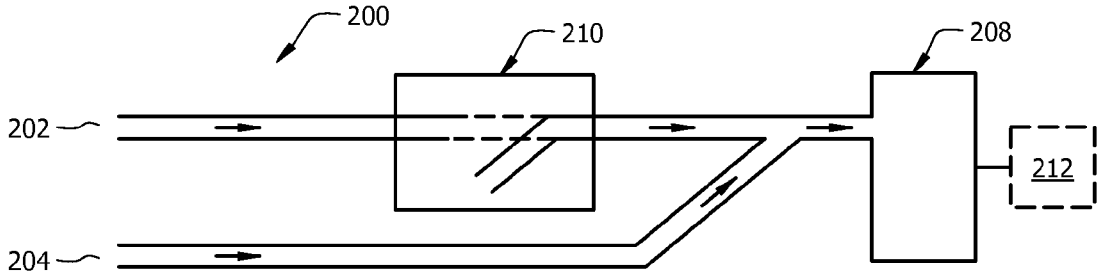
Figure 2C:
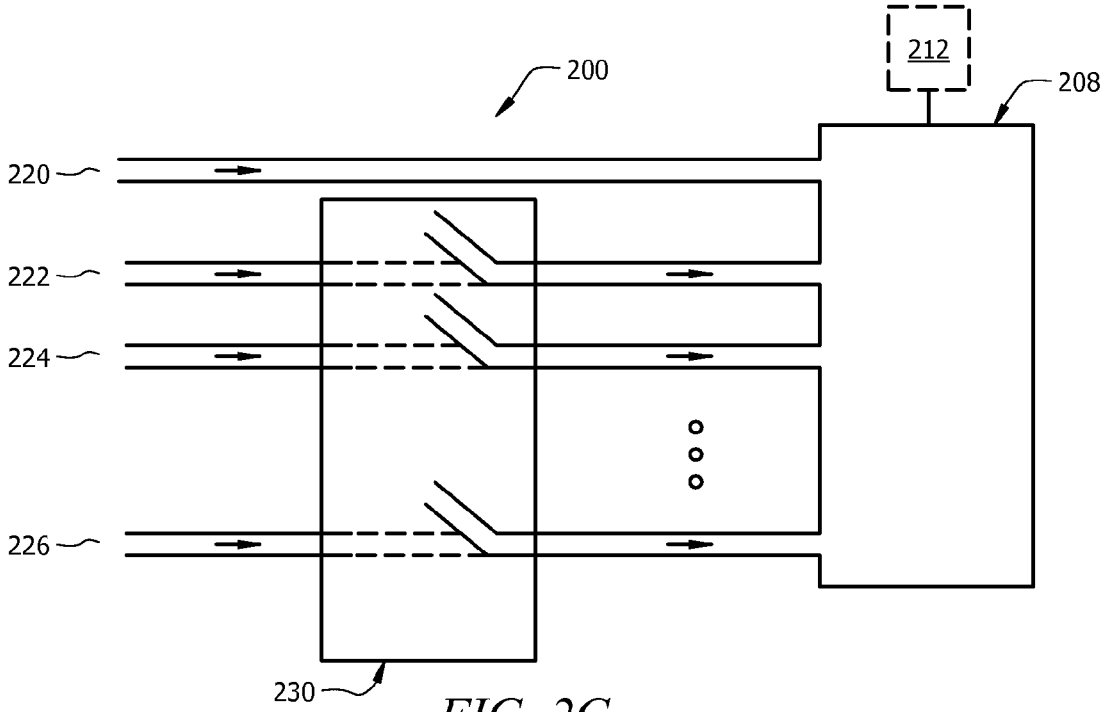

In some embodiments, the cartridge 110 may comprise at least two sample points 130 and 132, wherein sample streams run from the two sample points 130 and 132 to a gas sensor. FIGS. 2A-2C illustrate schematically several embodiment variants for communication between at least two sample streams and a gas sensor in a sampling system 200 for an end of service life indicator (ESLI). In an embodiment shown in FIG. 2A, a first sample stream 202 (sampling a first sample point in the cartridge) and a second sample stream 204 (sampling a second sample point in the cartridge) may be in fluid communication with the gas sensor 208, wherein the flow between the first sample stream 202, second sample stream 204, and the gas sensor 208 may be controlled by a valve 206. In some embodiments, the valve 206 may comprise a three-way valve, operable to alternate between the first sample stream 202 and the second sample steam 204, allowing one sample stream to reach the gas sensor 208 at a time (for comparison).

In an alternative embodiment, the two sample streams 202 and 204 may sample from the same sample point 130 or 132 within the cartridge or different sample points 130 and 132 within the cartridge, wherein one of the sample streams 202, 204 is altered in some way. For example, a first sample stream 202 may be filtered before reaching the gas sensor 208 to produce a "clean" sample that is compared to a second sample stream 204. Additionally, one or more of the sample streams may be dried before reaching the gas sensor 208.

In another embodiment, shown in FIG. 2B, the sampling system 200 may comprise a two-way valve 210, operable to control the flow from the first sample stream 202 to the gas sensor 208. The second sample stream 204 may be in constant fluid communication with the gas sensor 208, and the valve 210 may alternate between allowing the first sample stream 202 to mix with the second sample stream 204 and allowing only the second sample stream 204 to reach the gas sensor 208. Therefore, the gas sensor 208 may detect only the second sample stream 204 as well as a mixture of the first sample stream 202 and second sample stream 204. In some embodiments, the second sample stream 204 may sample from a sample point proximate to a rearward end of the cartridge and the first sample stream 202 may sample from a sample point proximate to a forward end of the cartridge. In other embodiments, the first sample stream 202 may sample from a sample point proximate to a rearward end of the cartridge and the second sample stream 204 may sample from a sample point proximate to a forward end of the cartridge. In some cases, a two-way valve 210 may be chosen because it may be less expensive than other options.

In another embodiment, shown in FIG. 2C, any number of sample streams (220, 222, 224, 226) may sample from different sample points within the cartridge. In an embodiment, a valve 230 may control the flow from the sample streams to the gas sensor 208. In some embodiments, one sample stream 220 may be in constant fluid communication with the gas sensor 208, while other sample streams 222, 224, 226 may be alternatively in fluid communication with the gas sensor 208 and controlled by the valve 230. The gas sensor 208 may be operable to compare inputs from the sample streams 220, 222, 224, 226. Testing of multiple sample points may allow for a stronger understanding of the gas propagation through the cartridge material.

In some embodiments, the gas sensor 208 may comprise a metal-oxide sensor and/or an electrochemical sensor. In some embodiments, more than one gas sensor 208 may be used to receive samples from the different sample points within the cartridge, wherein the gas sensors 208 may communicate and compare the gas levels detected from the sample points (although more typically, a single gas sensor might be used, with a switching valve). In some embodiments, the gas sensor 208 may comprise a sensor array comprising different sensors for sensing different gases, wherein each sensor in the array is exposed to the same gas mixture at any given time. Regardless, the sample streams are compared to determine end of service life (since the use of such a comparison approach may effectively counteract sensor drift concerns). In some embodiments, the gas sensor 208 may be coupled to an alert 212. Approaching end of service life may be indicated by the alert 212 when the gas level sensed at the rearward sample point 132 (proximate to a rearward end 114 of the cartridge 110) once again approaches the gas level sensed at the forward sample point 130 (proximate to a forward end 112 of the cartridge 110).

In an alternative embodiment, it may be possible to have a "non-drifting" sensor that does not require self-calibration (or comparison of sample streams). In this case, it may be possible to use two sensors 208 in communication with one another via a microcontroller. For example, gas sensor 208 may be split into gas sensors 208A and 208B (not shown in drawings), with 208A exposed to gas from one sample stream and 208B exposed to gas from another sample stream. The sensors 208A and 208B may communicate via the microcontroller to compare the two sample streams. If the sensors 208A and 208B show little drift, this configuration may be used without a valve controlling the flow from the one or more sample streams to the sensors 208A and 208B.

FIGS. 3A-3D illustrate a specific embodiment of a mechanical valve that may be used to control the flow between the two or more sample points in the cartridge and the gas sensor. The valve 300 may comprise an input port 302 in fluid communication with the interior of the respirator mask. The valve may also comprise a rubber diaphragm 304 that seals a chamber 305 of the valve 300 in communication with the input port 302 from the rest of the valve. The diaphragm 304 may attach to a housing 306 of the valve 300. In some embodiments, the valve 300 may comprise a port 303 on the opposite side of the rubber diaphragm 304 from port 302 that is open to ambient air. The rubber diaphragm 304 may be operable to flex in response to pressure changes within the chamber 305 provided by the pressure change from the breathing of a user through the input port 302. The rubber diaphragm 304 may be coupled to seals 308 and 310 (via a rod 312, for example). The seals 308 and 310 may be actuated to move within a cylindrical portion 307 of the valve 300 by the movement of the diaphragm 304 (for example, via the rod 312). The seals 308 and 310 may comprise a disk-like shape, such that they fill the cross-sectional area of the cylindrical portion 307 of the valve 300. In some embodiments, the seals 308 and 310 may comprise plugs 309 and 311 around their circumference operable to block any fluid communication at the edges of the seals 308 and 310. In some embodiments, the plugs 309 and 311 may not be required to have strong sealing capabilities, as the pressure differences across them may be small.

The cylindrical portion 307 of the valve may comprise three or more ports 320, 322 and 324, wherein port 320 may be in fluid communication with a gas sensor, port 322 may be in fluid communication with a first sample point within the cartridge, and port 324 may be in fluid communication with a second sample point within the cartridge. In some embodiments, the ports 320, 322 and 324 may be located proximate to one another, while in other embodiments, the ports 320, 322, and 324 may be spread out around the circumference of the cylindrical portion 307 of the valve 300. The seals 308 and 310 may be coupled to an indexing mechanism 330 comprising a spring 332, wherein the indexing mechanism 330 may control the movement of the seals 308 and 310 via the rod 312. In some embodiments, the indexing mechanism 330 may also be called a click-pen mechanism or click-pen assembly.

Figure 3B:
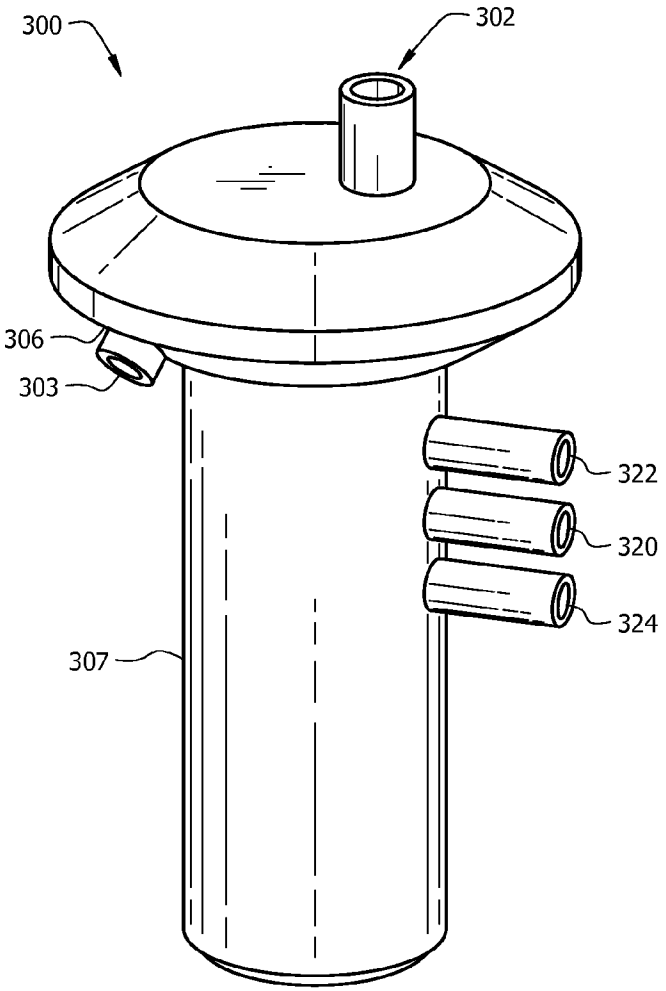
FIGS. 3A-3E illustrate embodiments of a valve comprising an indexing mechanism.
Figure 3A:
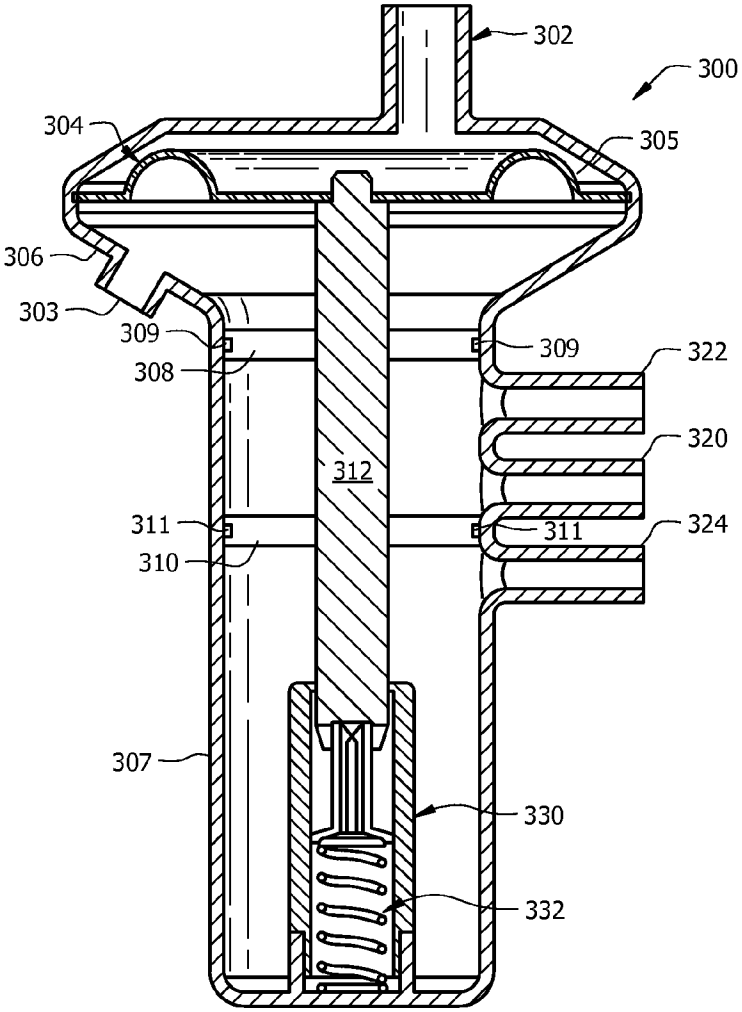
Figure 3D:
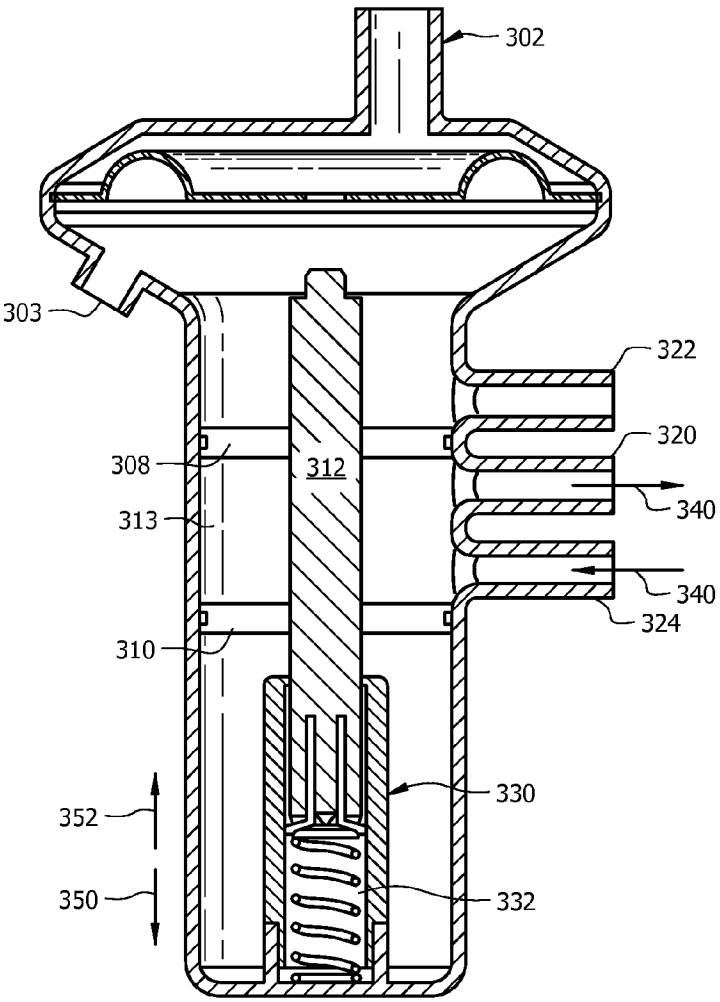
Figure 3C:
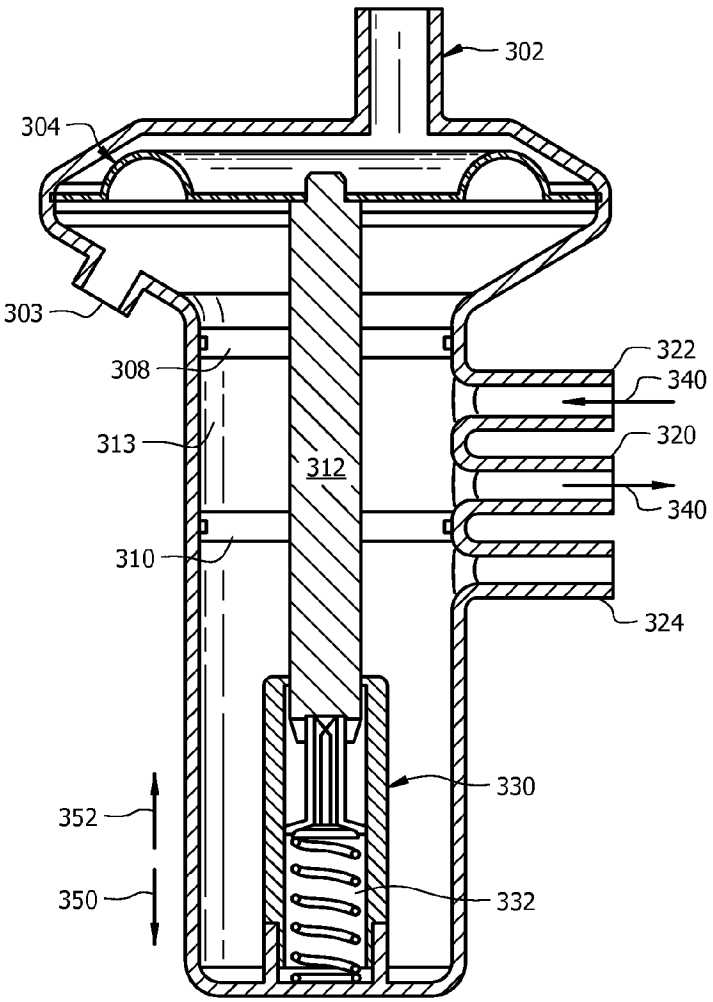

As shown in FIGS. 3C and 3D, the seals 308 and 310 may be operable to move between at least two positions. A first position of the seals 308 and 310, shown in FIG. 3C, may allow for gas flow 340 into the valve 300 through the port 322 from the first sample point and out of the valve 300 through the port 320 to the gas sensor. The seals 308 and 310 may contain the gas flow 340 within the chamber 313 between the seals 308 and 310 and may block gas flow 340 to any other area of the valve 300. When the seals 308 and 310 are in the first position, gas flow 340 into or out of the port 324 from the second sample point may be blocked from entering the chamber 313 between the seals 308 and 310. In other words, the port 324 (and the second sample point) may not be in fluid communication with the port 320 (and the gas sensor) when the seals 308 and 310 are in the first position. The first position of the seals 308 and 310 may allow for the gas sensor to receive sample gas from only the first sample point within the cartridge via the ports 320 and 322 of the valve 300.

A second position of the seals 308 and 310, shown in FIG. 3D, may allow for gas flow 340 into the valve 300 through the port 324 from the second sample point and out of the valve 300 through the port 320 to the gas sensor. The seals 308 and 310 may contain the gas flow 340 within the chamber 313 between the seals 308 and 310 and may block gas flow 340 to any other area of the valve 300. When the seals 308 and 310 are in the second position, gas flow 340 into or out of the port 322 from the first sample point may be blocked from entering the chamber 313 between the seals 308 and 310. In other words, the port 322 (and the first sample point) may not be in fluid communication with the port 320 (and the gas sensor) when the seals 308 and 310 are in the second position. The second position of the seals 308 and 310 may allow for the gas sensor to receive sample gas from only the second sample point within the cartridge via the ports 320 and 324 of the valve 300. In some embodiments, the gas flow 340 through the valve 300 to the gas sensor may be controlled by the pressure differential from a user's breathing. In other embodiments, the gas flow 340 through the valve 300 to the gas sensor may be controlled by another driving force, such as a small fan for example.

In some embodiments, the indexing mechanism 330 may control the movement of the rod 312 and therefore the seals 308 and 310. The indexing mechanism 330 may be operable to allow movement of the seals 308 and 310 between the first position (FIG. 3C) and the second position (FIG. 3D) at a multiple of breathing cycles of the user. In some embodiments, the indexing mechanism 330 may actuate on every other breathing cycle, while in other embodiments, the indexing mechanism 330 may actuate on a set number of breathing cycles. When the diaphragm 304 flexes downward 350 (via breathing cycle pressure change), the rod 312 may be forced downward 350, actuating the indexing mechanism 330. Then, the diaphragm 304 may flex upward 352 (pressure change) drawing the rod 312 upward, wherein the seals 308 and 310 may move to the first position (FIG. 3C). When the diaphragm 304 flexes downward 350 again (via breathing cycle pressure change), the rod 312 may be forced downward 350 again, actuating the indexing mechanism 330. Then, the diaphragm 304 may flex upward 352 (pressure change) drawing the rod 312 upward, wherein the seals 308 and 310 may move to the second position (FIG. 3D).

The spring 332 of the indexing mechanism 330 may be operable to control the position of the rod 312 within the indexing mechanism 330. In some embodiments, the spring 332 may bias the rod 312 in an upward 352 direction. As known by those skilled in the art, the indexing mechanism 330 may comprise any number of catches, stubs, teeth, lugs, cams, slots, ridges, flanges, guides, or other formations operable to allow the indexing mechanism 330 to control the movement of the seals 308 and 310 (via the rod 312) between the positions described above. In some embodiments, the indexing mechanism 330 may be operable to interact with a portion of the rod 312 to control the movement of the rod 312, wherein the rod 312 may comprise one or more formations operable to interact with formations of the indexing mechanism 330. Although the indexing mechanism 330 is shown in FIGS. 3A-3D as being coupled to a downward 350 end of the rod 312, in alternative embodiments, the indexing mechanism 330 may be coupled to the rod in another fashion, such as at the opposite (or upward 352) end of the rod 312 (wherein the spring 332 may bias the rod 312 in a downward 350 direction).

Figure 3E:
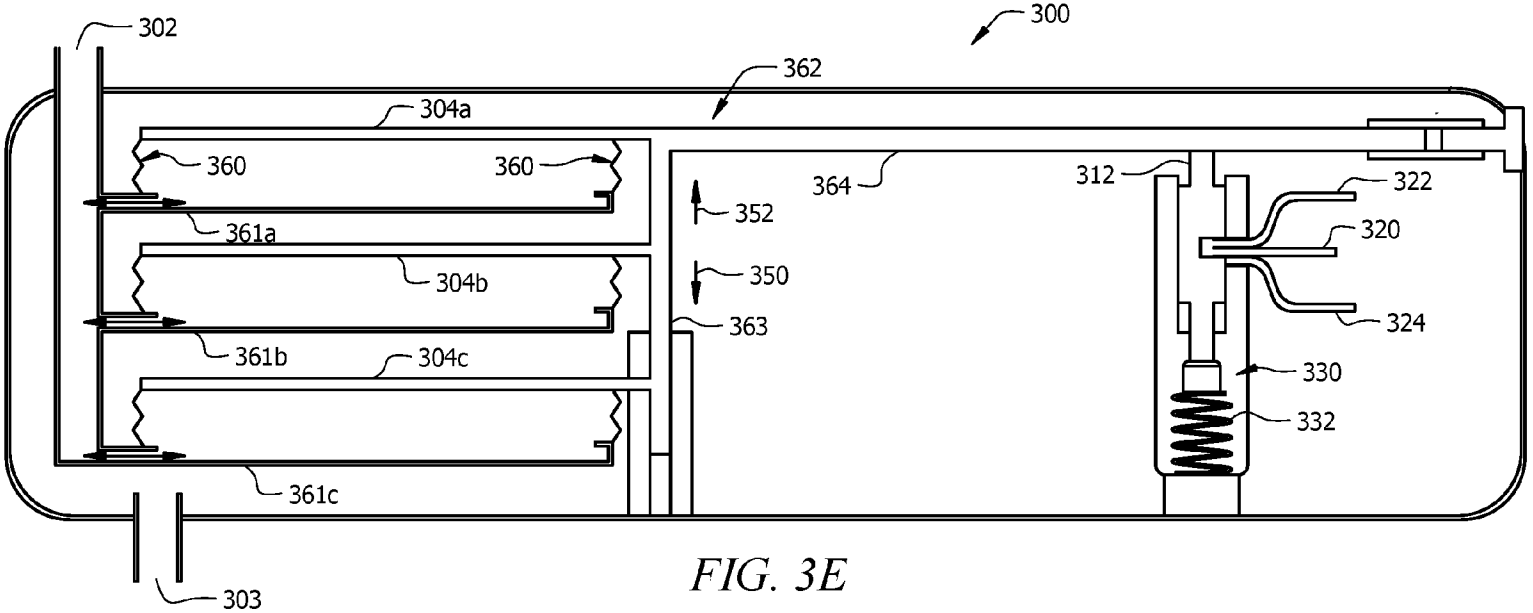

FIG. 3E illustrates an alternative embodiment of the mechanical valve. The valve 300 of FIG. 3E comprises multiple diaphragms 304*a*, 304*b*, and 304*c*. The embodiment of FIG. 3E shows three diaphragms, but any number of diaphragms may be used. The diaphragms 304*a*, 304*b*, 304*c* may be operable to move upward 352 and downward 350 with the change pressure from a user breathing, wherein the port 302 is in fluid communication with the inside of the mask (as described above). In some embodiments, the diaphragms 304*a*, 304*b*, 304*c* may couple to fixed surfaces 361*a*, 361*b*, 361*c* via bellows 360, wherein the bellows 360 may be flexible to allow movement of the diaphragms 304*a*, 304*b*, 304*c*. The diaphragms 304*a*, 304*b*, 304*c* may connect to a level arm 362 comprising a vertical section 363 and a horizontal section 364. The level arm 362 may couple to the rod 312, wherein the rod 312 may interact with the indexing mechanism 330 as described above.

Figure 4A:
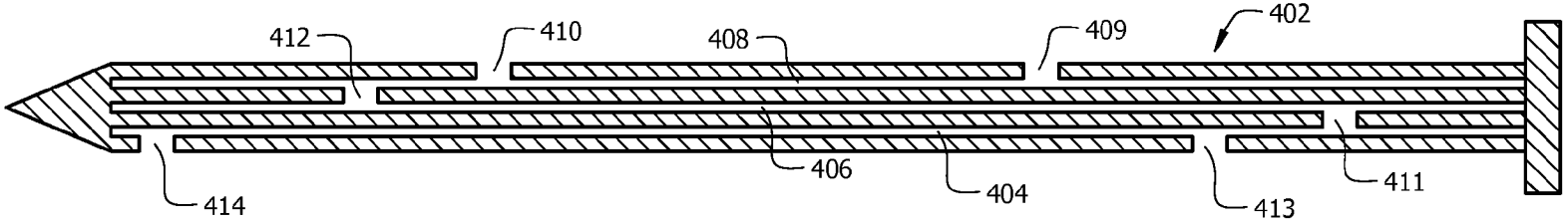
FIGS. 4A-4C illustrate an insert operable to provide two or more sample streams from the interior of a filter cartridge to a gas sensor.
Figure 4B:
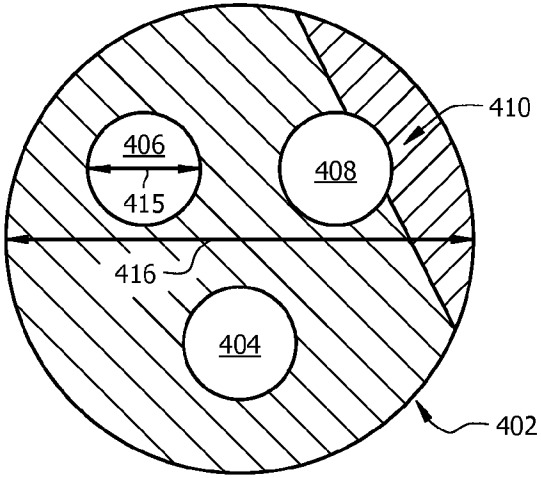
Figure 4C:
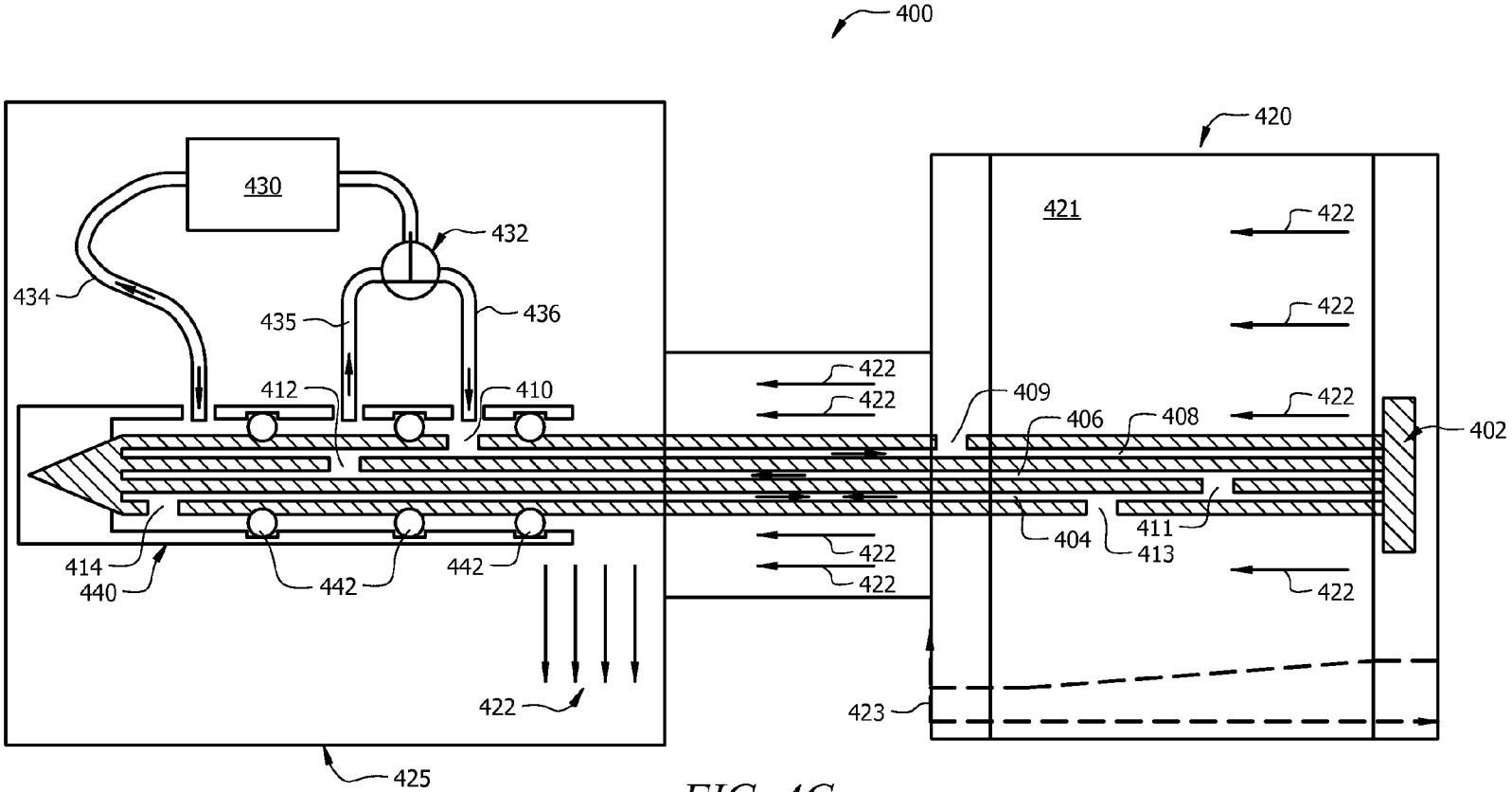

FIGS. 4A-4C illustrate one possible embodiment for providing at least two sample streams from the interior of a filter cartridge to a gas sensor. FIG. 4A shows an insert 402 which may be placed within a filter cartridge. The insert 402 comprises a cylindrical shape and three tube-like cavities 404, 406, and 408. The insert may also comprise cut-outs 409, 410, 411, 412, 413, and 414 that provide access to the three cavities 404, 406, and 408. In one embodiment, each cavity 404, 406, 408 may comprise two cut-outs, for example cavity 408 may comprise a first cut-out 409 and a second cut-out 410, cavity 406 may comprise a first cut-out 411 and a second cut-out 412, and cavity 404 may comprise a first cut-out 413 and a second cut-out 414. Each of the cut-outs may allow fluid to flow into and/or out of the cavities.

FIG. 4B shows a cross sectional view of the insert 402 at the location of the cut-out 410 for the cavity 408. The diameter 416 of the insert may be approximately 5 mm and the diameter 415 of each of the cavities 404, 406, and 408 may be approximately 1 mm. In an embodiment, the insert 402 may be approximately 50 mm in length. The cut-outs 409, 410, 411, 412, 413, and 414 may be created during molding of the insert 402 or cutting after molding. The insert 402 may comprise a plastic material, metal, paper, wood, or any other material as long as the material, to a measureable degree, does not absorb and/or desorb the targeted gas (or gases) to be sampled and does not outgas (or release) any targeted gas and/or any gas that could poison or in any other way harm the gas sensors.

As shown in FIG. 4C, in an end-of-service-life indicator system 400, the insert 402 may be placed within a filter cartridge 420 comprising filtering material 421, wherein a portion of the insert 402 may be located within the cartridge 420 and another portion of the insert 402 may be located within the mask 425 (or sensor housing). The cavities 404, 406, and 408 may carry sample gas from within the cartridge 420 to a gas sensor 430, wherein, in some embodiments, the gas sensor 430 may be located within or on the mask 425. Sample streams 434, 435, and 436 may carry the gas from the cavities 404, 406, and 408 within the insert 402 to the gas sensor 430. In some embodiments, a valve 432 may control the flow for two or more of the sample streams 434, 435, and 436. The cut-outs 410, 412, and 414 in the insert 402 may be in fluid communication with the sample streams 434, 435, and 436, and may be sealed off from one another by seals 442, wherein the seals 442 may be connected to a housing 440. The cut outs 409, 411, and 413 may be in fluid communication with the air within the cartridge 420. The breathing of a user may follow the path shown by arrows 422, and the pressure gradient 423 within the cartridge 420 caused by the breathing of the user may drive the gas samples through the cavities 404, 406, and 408 of the insert 402 and sample streams 434, 435, and 436 to and/or from the gas sensor 430. In an embodiment, the insert 402 may sample from two or more sample points within the filtering material 421 of the cartridge 420 (shown at cut-outs 411 and 413), wherein the gas sensor 430 may compare the gas sampled from the two or more sample points.

Some embodiments of the disclosure may comprise methods of detecting effective-end-of-service-life for a filter cartridge for a respirator using a gas sensor for detecting gas levels. The method may comprise receiving sample streams from at least two sample points in a filter cartridge, wherein the two or more sample points are located at different depths within the cartridge. The sample streams may be in fluid communication with a gas sensor operable to receive the at least two sample streams and compare the gas level present in the at least two sample streams. The method may also comprise alternating the flow from the sample streams to the gas sensor via a valve. In some embodiments, the valve may comprise one or more of the following: a piezoelectric valve, a solenoid valve, a bi-stable solenoid valve, a flap valve or mechanical valve actuated by the pressure from a user's breathing, a check valve, a valve actuated by user motion, and an electrostatic valve. Then, the method may comprise comparing the gas level present in the sample streams. Additionally, the method may further comprise indicating end of service life when the two sample streams approach equality for a second time, wherein initially the sample streams are approximately equal because no gas has penetrated the cartridge, then the sample streams become unequal as gas penetrates to a forward sample point, and then the sample streams approach equality once again as gas penetrates further in the cartridge to the rearward sample point.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An end-of-service-life indicator system for a filter cartridge for a respirator, comprising:

a gas sensor;

at least two sample streams from the cartridge alternatively in fluid communication with the gas sensor; and a valve controlling the flow from the at least two sample streams to the gas sensor, wherein the gas sensor compares the at least two sample streams;

wherein each of the least two sample streams samples from sample points within the cartridge and the sample points for the sample streams are located at different depths within the cartridge.

2. The system of claim 1, further comprising an alert coupled to the gas sensor operable to indicate approaching end-of-service-life of the cartridge, wherein approaching end-of-service-life is indicated when a gas level sensed at a sample point proximate to a rearward end of the cartridge approaches a gas level sensed at a sample point proximate to a forward end of the cartridge.

3. The system of claim 1 wherein the gas sensor comprises one of a metal-oxide sensor or an electrochemical sensor.

4. The system of claim 1 wherein the valve comprises one or more of the following: a piezoelectric valve, a solenoid valve, a bi-stable solenoid valve, a flap valve actuated by the pressure from a user's breathing, a check valve, a valve actuated by user motion, and an electrostatic valve.

5. The system of claim 1 wherein the valve comprises a mechanical valve comprising an indexing mechanism, a diaphragm that activates the indexing mechanism, and a line to the interior of the respirator, wherein the valve is actuated by the pressure from a user's breathing within the respirator.

6. The system of claim 1 wherein the valve is actuated by the pressure from a user's breathing and switches the flow to the gas sensor from one of the at least two sample streams to another of the at least two sample streams after a set number of breathing cycles.

7. The system of claim 1 wherein the valve comprises a two-way valve operable to alternate between one sample stream and a mixture of the at least two sample streams.

8. The system of claim 1 Wherein the valve comprises a three-way valve operable to alternate between a first sample stream and a second sample stream.

9. The system of claim 1 wherein the at least two sample streams comprise three or more sample streams from three or more different sample points within the cartridge, wherein the gas sensor compares the sample streams from the three or more sample points.

10. The system of claim 9 further comprising an alert in communication with the gas sensor, wherein the alert comprises a plurality of indications or warnings to indicate to the user when the gas has penetrated to each of the three or more different sample points in the cartridge.

11. An end-of-service-life indicator system for a filter cartridge for a respirator wherein the cartridge has a forward end and a rearward end, comprising:

a gas sensor;

sample streams from at least two sample points in the cartridge to the gas sensor, wherein the gas sensor compares the gas level of the two sample streams, and wherein one sample point is proximate to the rearward end of the cartridge and another sample point is proximate to the forward end of the cartridge; and a valve controlling the flow from the at least two sample streams to the gas sensor, wherein the valve comprises:

an air tight housing with an opening in fluid communication with the interior of a mask of the respirator and the breathing of a user, and a plurality of ports in fluid communication with the gas sensor and the sample streams, a diaphragm operable to move in response to pressure changes caused by the breathing of the user within the respirator, two or more seals operable to isolate a portion of the housing about one or more of the plurality of ports, wherein the seals are operable to control flow through the plurality of ports from the sample streams to the gas sensor, and an indexing mechanism coupled to the diaphragm and to the seals, such that movement of the diaphragm activates the indexing mechanism, thereby positioning the seals with respect to the plurality of ports and controlling flowfrom the sample streams to the gas sensor.

12. The system of claim 11 wherein the seals of the valve allow one sample stream to reach the gas sensor at a time depending on the position of the indexing mechanism.

13. The system of claim 11 wherein the indexing mechanism positions the seals to alternate the sample streams at a multiple of breathing cycles of a user, to ensure that the breathing cycle can always be used to drive flow in a single direction to the gas sensor.

14. The system of claim 11 wherein the diaphragm of the valve comprises over-molded rubber and is fixed to an inner wall surface of the housing.

15. The system of claim 11 wherein approaching end-of-service-life is indicated when the gas level sensed at the sample point proximate to the rearward end of the cartridge approaches the gas level sensed at the sample point proximate to the forward end of the cartridge.

16. The system of claim 11 wherein comparing the at least two sample streams overcomes the effect of voltage drift on the accuracy of the gas sensor.

17. A method of detecting effective-end-of-service-life for a filter cartridge for a respirator using a gas sensor for detecting gas levels comprising:

receiving sample streams from at least two sample points in a filter cartridge, wherein the two or more sample points are located at different depths within the cartridge;

alternating the flow from the sample streams to the gas sensor via a valve; and comparing the gas level present in the sample streams.

18. The method of claim 17 further comprising indicating end of service life when the two sample streams approach equality for a second time, wherein initially the sample streams are approximately equal because no gas has penetrated the cartridge, then the sample streams become unequal as gas penetrates to a forward sample point, and then the sample streams approach equality once again as gas penetrates further in the cartridge to the rearward sample point.

19. The method of claim 17 wherein a gas sensor receives the at least two sample streams and compares the gas level present in the at least two sample streams.

20. The method of claim 17 wherein the valve comprises one or more of the following: a piezoelectric valve, a solenoid valve, a bi-stable solenoid valve, a flap valve or mechanical valve actuated by the pressure from a user's breathing, a check valve, a valve actuated by user motion, and an electrostatic valve.

* * * * *